US005077841A

United States Patent [19]

Sugai

[11] Patent Number: 5,077,841

[45] Date of Patent: Jan. 7, 1992

[54] HYDROMASSAGING APPARATUS FOR USE IN A BATHTUB

[75] Inventor: Haruo Sugai, Hikone, Japan

[73] Assignee: Matsushita Electric Works, Ltd., Japan

[21] Appl. No.: 476,695

[22] Filed: Feb. 8, 1990

[30] Foreign Application Priority Data

Feb. 15, 1989 [JP] Japan ..... 1-35269
Mar. 15, 1989 [JP] Japan ..... 1-63155

[51] Int. Cl.[5] ..... A61H 33/02

[52] U.S. Cl. ..... 4/542; 4/544; 239/579

[58] Field of Search ..... 4/542-544, 4/492, 496, 541; 251/349, 352, 341; 239/587-589, 579; 128/66, 365-367

[56] References Cited

U.S. PATENT DOCUMENTS

| | | | |
|---|---|---|---|
| 2,738,787 | 3/1956 | Jacuzzi et al. | 4/559 X |
| 3,406,680 | 10/1968 | Roden | 4/544 X |
| 3,802,422 | 4/1974 | Hurst | 128/66 |
| 3,859,990 | 1/1975 | Simon | 128/66 |
| 4,273,289 | 6/1981 | Jette | 239/579 X |
| 4,360,160 | 11/1982 | Jette | 239/587 B X |
| 4,398,668 | 8/1983 | Jette | 239/587 X |
| 4,850,540 | 7/1989 | Taniguchi | 239/579 |
| 4,942,871 | 7/1990 | Hara | 4/492 X |
| 4,957,101 | 9/1990 | Hara | 4/542 |
| 4,984,313 | 1/1991 | Hara | 4/544 X |

FOREIGN PATENT DOCUMENTS

| | | | |
|---|---|---|---|
| 2827187 | 1/1980 | Fed. Rep. of Germany | 4/488 |
| 691149 | 10/1930 | France | 4/542 |
| 353605 | 10/1937 | Italy | 239/587 |
| 57-130628 | 8/1982 | Japan . | |
| 59-42039 | 12/1984 | Japan . | |

*Primary Examiner*—Henry J. Recla
*Assistant Examiner*—Robert M. Fetsuga
*Attorney, Agent, or Firm*—Stevens, Davis, Miller & Mosher

[57] ABSTRACT

A hydromassaging apparatus for use in a bathtub comprises a housing provided with a pump for drawing water from the bathtub to provide a forced flow of water through a flow channel leading from the pump to a plurality of spouts. Air is intermixed into the forced water flow downstream of the pump to generate a water-air mixture to be discharged out of the sprouts into the bathtub water. At least one of the spouts is provided with a directional nozzle which is movable relative to the spout for adjusting the direction of the water-air mixture into the bathtub. The directional nozzle projects from the housing to be accessible by the user and is kept in fluid communication with the corresponding spout while it is angularly displaced within a limited range of angles relative to an axis of the spout so as to discharge the water-air jet therethrough. When the directional nozzle is tilted beyond the limited range of angles, it becomes out of fluid communication with the spout to thereby stop discharging the water-air jet through the nozzle and in turn permits the water-air mixture to be discharged through the other spout or spouts. In this manner, the water-air mixture can be can be discharged selectively through the different spouts simply by manipulating the directional nozzle to change its angular position.

3 Claims, 10 Drawing Sheets 31
30
127
32
33
10
12
104
103
101
100
102
21
17
95
54
55
52
53
115
114
110
113
112
111
84
56
92
60
50
66
64
78
74
126
90
51
14
122
120
123
125
121
18
13
41
42
42
40
20
26
85
24
11

HYDROMASSAGING APPARATUS FOR USE IN A BATHTUB

BACKGROUND OF THE INVENTION

1. Field of the Invention

The present invention is directed to a hydromassaging apparatus for use in a bathtub to discharge a water-air jet into the bathtub for hydromassage treatment, and more particularly to such hydromassage apparatus having a plurality of spouts discharging a water-air jet into the bathtub water.

2. Description of the Prior Art

There has been known hydromassage apparatus having more than one spout for discharging a water-air jet into bathtub water, as disclosed in Japanese Utility Model Early Publication (Kokai) No. 57-130628. The apparatus includes a pump for providing a forced flow of water which is directed through a flow channel leading to plural spouts. The flow channel is diverged to have individual branches leading to plural spouts. Formed at the diverging point of the flow channel is a switch valve for selectively discharging a water-air jet from one of the spouts into the bathtub water. The switch valve is operatively connected through a complicated linkage to a handle ring provided on the exterior of the apparatus to be manipulated by the user. For switching the water-air spout, therefore, the apparatus is required to have a number of additional components including the valve and the handle ring, and is further required to have water-tight sealing around the switch valve, which adds complexity to the structure of the apparatus and therefore is a disadvantage of the prior apparatus. Another prior apparatus is disclosed in Japanese Utility Model Publication (Kokoku) No. 59-42039 which has a directional nozzle for adjusting the direction of discharging the water-air jet to provide a comfortable and efficient massaging effect.

SUMMARY OF THE INVENTION

The present invention is contemplated to eliminate the above disadvantage while retaining the ability to vary the flow direction of the water-air jet for providing a comfortable massaging effect. In a hydromassaging apparatus of the present invention, a directional nozzle is utilized not only to adjust the direction of the water-air jet but also to define itself a valve for switching the water-air jet to be selectively discharged through different spouts. The apparatus comprises a housing incorporating a pump for drawing water from a bathtub to provide a forced flow of water which is directed through a flow channel diverging to the plural spouts. Air is intermixed into the water downstream of the pump and upstream of the point of divergence so as to produce the water-air jet to be discharged into the bathtub water selectively through the individual spouts. At least one of the spouts is provided with a directional nozzle which extends outwardly of the housing to be accessible by the user and has an axial bore discharging the water-air jet therethrough. The directional nozzle is movable relative to the corresponding spout for adjusting the direction of the water-air jet and is coupled to the spout in such a manner that, when the nozzle is angularly displaced within a limited amount, the axial bore is kept in fluid communication with the spout for discharging the water-air jet in the direction determined by the nozzle orientation. When the nozzle is displaced beyond the limited amount relative to the spout, the axial bore of the nozzle comes out of fluid communication with the spout to thereby close the spout and switch the water-air mixture to be discharged through the other spout or spouts. In this manner, the directional nozzle can act itself as a valve to switch the spouts for discharging the water-air mixture, which eliminates the necessity of any additional valve mechanism or components for switching the flow of the water-air mixture between the plural spouts.

It is therefore a primary object of the present invention to provide a hydromassaging apparatus which is capable of switching a water-air mixture to be selectively discharged from the different spouts simply by manipulating the directional nozzle and without requiring any additional complicated mechanism.

The flow channel is designed to have individual branches extending from the point of divergence in different directions to terminate in the respective spouts. One of the branches leading to the spout having the directional nozzle is configured to extend in substantially the same direction as the direction of the water-air mixture reaching the point of divergence from the pump such that substantially all of the water-air mixture is directed to the spout with the direction nozzle and no substantial flow of the mixture is directed to the other spout while the directional nozzle is in an enable position of discharging the water-air mixture therethrough. As a consequence, the water-air mixture will rush through the directional nozzle in the enable position to thereby produce a relatively strong flow of the water-air mixture through the nozzle. The other branches leading to the other spouts are configured to extend in directions different from the direction of the water-air mixture reaching the point of divergence so that, when the directional nozzle is a rest position of closing the associated spout, the flow of the water-air mixture is weakened as flowing through the individual branches to provide a mild flow of the water-air mixture being discharged through the other spouts. Therefore, it is possible to selectively enjoy an intense or mild water-air jet simply by manipulating the directional nozzle between the open and closed positions.

It is therefore another object of the present invention to provide a water-air jet generating apparatus which is capable of providing an intense or mild water-air jet selectively from different spouts.

In a preferred embodiment, the housing has three spouts which are aligned horizontally with only the center one of a spouts being provided with the directional nozzle. The other side spouts are suitably spaced apart to direct a relatively weak water-air jet for applying mild hydromassaging effect to, for example, parts on the opposite sides of the spine or the bottoms of the feet of the user who is taking a bath.

These and still other objects and advantages of the present invention will become more apparent from the following description of a preferred embodiment when taken in conjunction with the attached drawings.

DETAILED DESCRIPTION OF THE EMBODIMENT

Figure 1:
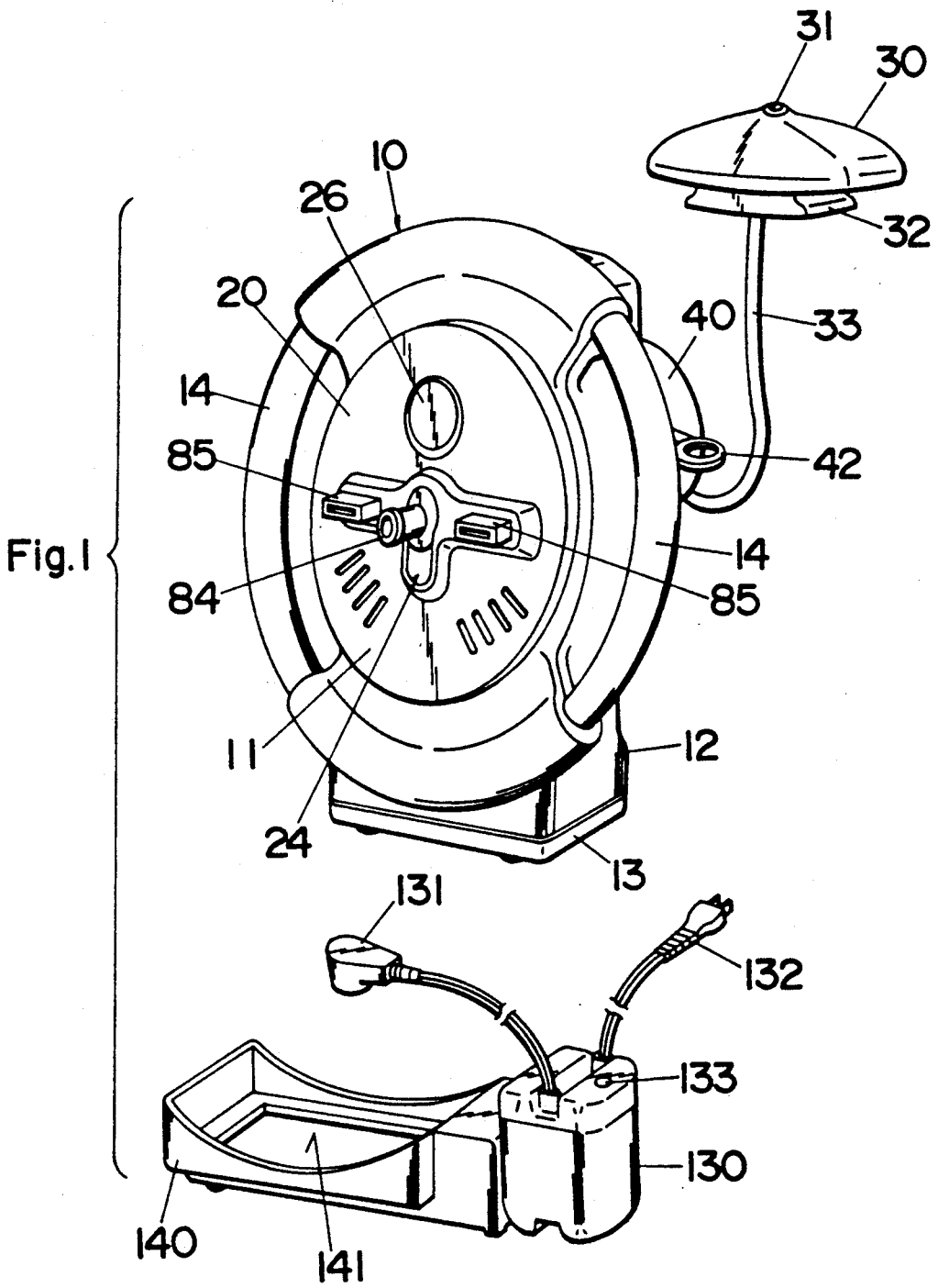
FIG. 1 is a perspective view of a hydromassaging apparatus in accordance with a preferred embodiment of the present invention.

Referring now to FIG. 1, there is shown a hydromassaging apparatus in accordance with a preferred embodiment of the present invention. The apparatus is adapted in use to be immersed within the water of a bathtub, as shown in FIG. 2, to draw the water and discharge a water-air mixture for delivering a massaging action to a suitable portion of the user's body, as shown in FIGS. 3A and 3B.

Figure 6:
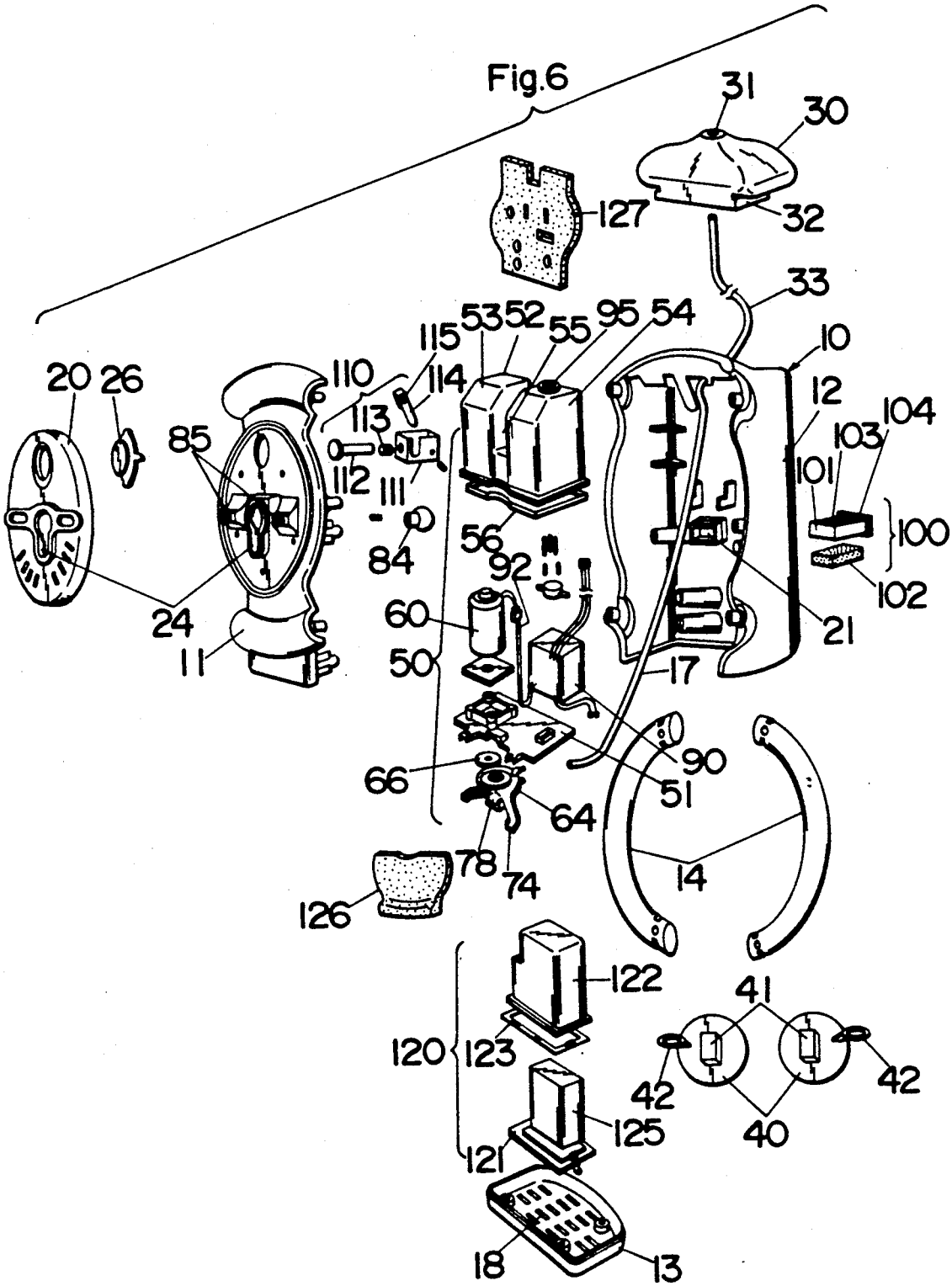
FIG. 6 is an exploded perspective view of the above apparatus.

The apparatus comprises a housing 10 and a float 30 detachable to the upper end of the housing 10 so as to keep the housing 10 suspended within the surface of the bathtub water. As shown in FIG. 6, the housing 10 is made of a front cover 11, a rear cover 12, and a bottom cover 13 to enclose a pump unit 50 for generation of the water-air mixture and a battery unit 120 energizing the pump unit 50. A face plate 20 is fitted over the front cover 11. Also included in the housing 10 is a pair of hollow handles 14 which are shaped from a soft plastic material into a curved configuration and are assembled with the upper and lower ends thereof held between the front and rear covers 11 and 12 so that the handles 14 project laterally of the housing 10 to be grasped by the hands of the user. The handles 14 add buoyancy to the housing 10 for assisting to suspend the same in the bathtub water, act as a bumper for protection of the housing 10 against shocks, and further provide a soft feeling grip. The float 30 is shaped into a hollow member such as by blow forming to have an air inlet 31 at its top and also to have slider rails 32 on its bottom for slidable engagement with corresponding grooves 15 formed in the upper end of the housing 10 such that the float 30 is slidably attached to the upper end of the housing 10 from the rear. An air tube 33 extends from the bottom of the float 30 and is coupled to a port 16 at the upper end of the housing 10 from which a flexible pipe 17 is routed to the pump unit 50 in order to supply air for generation of the water-air mixture, as described hereinafter.

Figure 2:
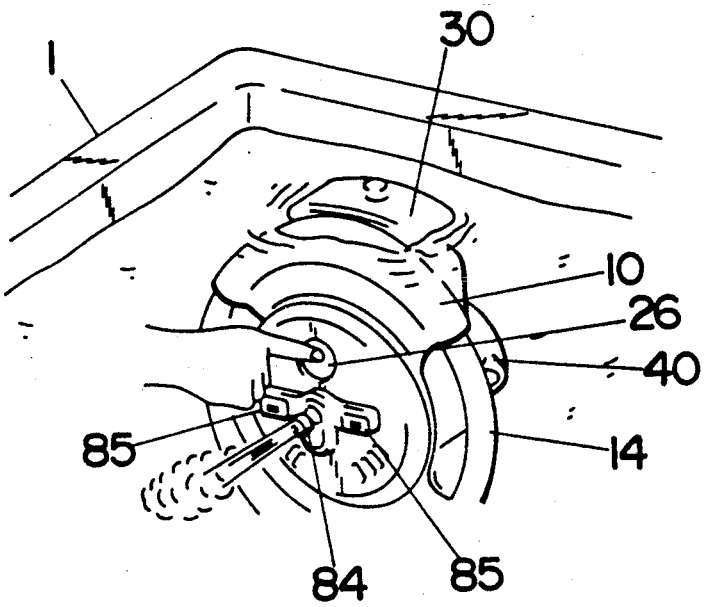
FIG. 2 is schematic view of the above apparatus in its position mounted within a bathtub.
Figure 3A:
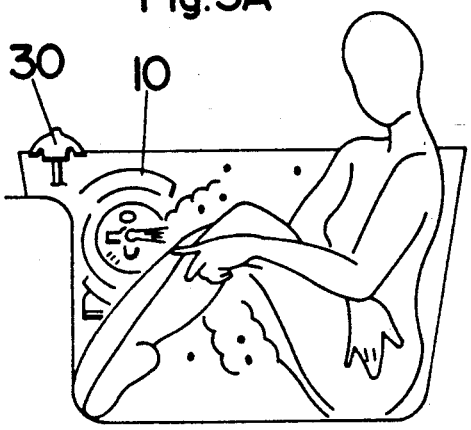
FIGS. 3A and 3B are explanatory views respectively illustrating two different styles of uses of the apparatus.
Figure 3B:
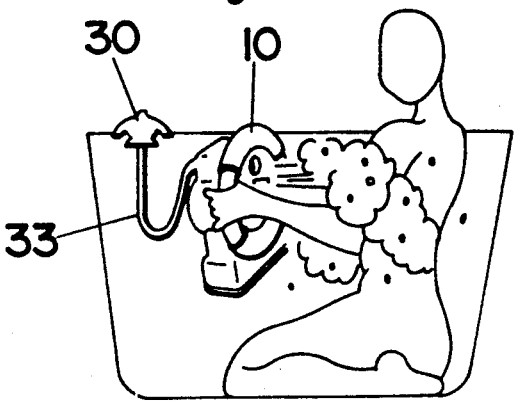

Provided on the rear of the housing 10 is a pair of suction cups 40 for detachably mounting the housing 10 on a side wall of a bathtub 1 to keep the apparatus in a fixed position, as shown in FIGS. 2 and 3A in which case the float 30 is attached on the apparatus. The apparatus can be also used as detached from the bathtub wall, as shown in FIG. 3B, in which case, the apparatus is held at a suitable position by the user with the float 30 detached from the apparatus. Each suction cup 40 is fixed to the housing 10 by engaging an anchor piece 41 into a complementary slot in the rear of the housing 10. Although not shown in the figures, the slot includes a stopper which can lock and release the piece 41 of the suction cup 40 to and from the housing 10. Each suction cup 40 is also provided with a release ring 42 which projects outwardly of the housing 10 to be located behind of each one of the handles 14 so that the user can easily manipulate the release ring 42 by the fingers for detachment of the suction cup 40 while holding the handles 14 by the other fingers.

Figure 4:
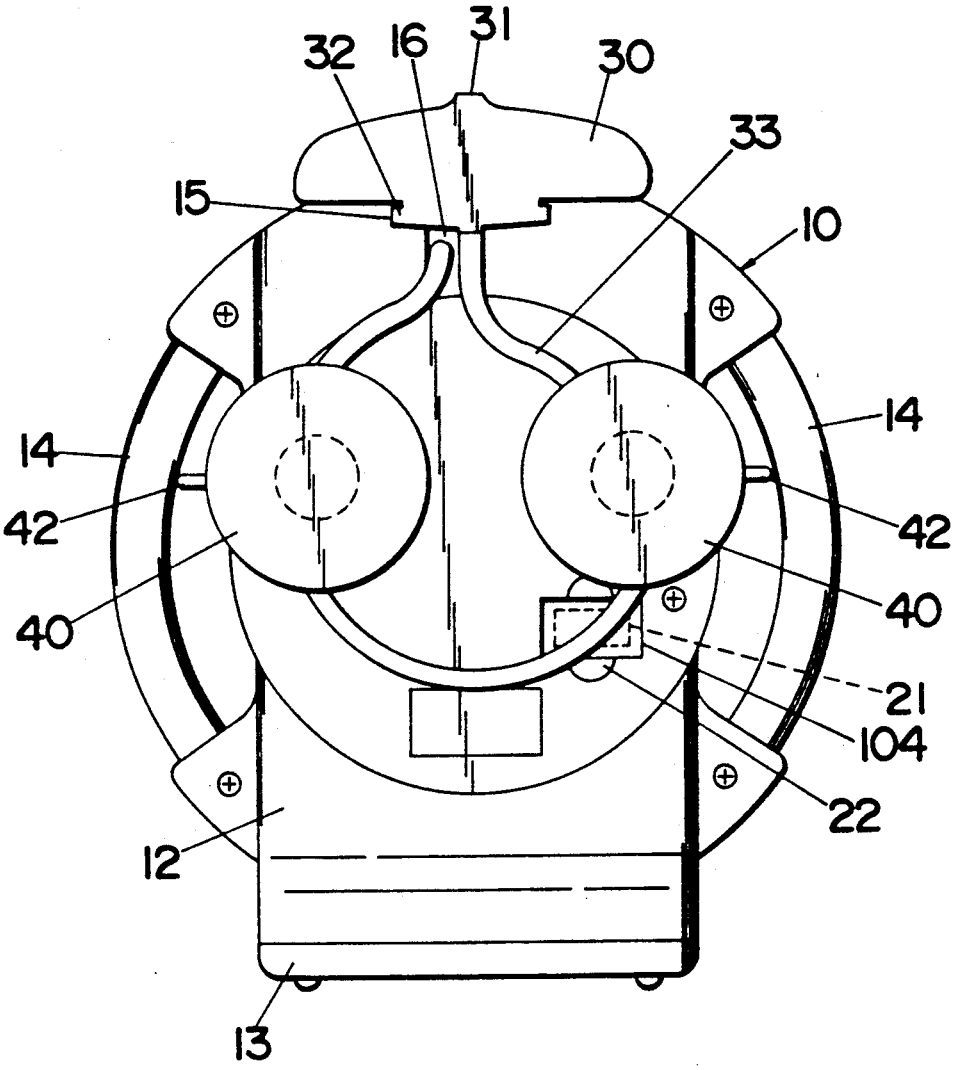
FIG. 4 is a rear view of the above apparatus.
Figure 5:
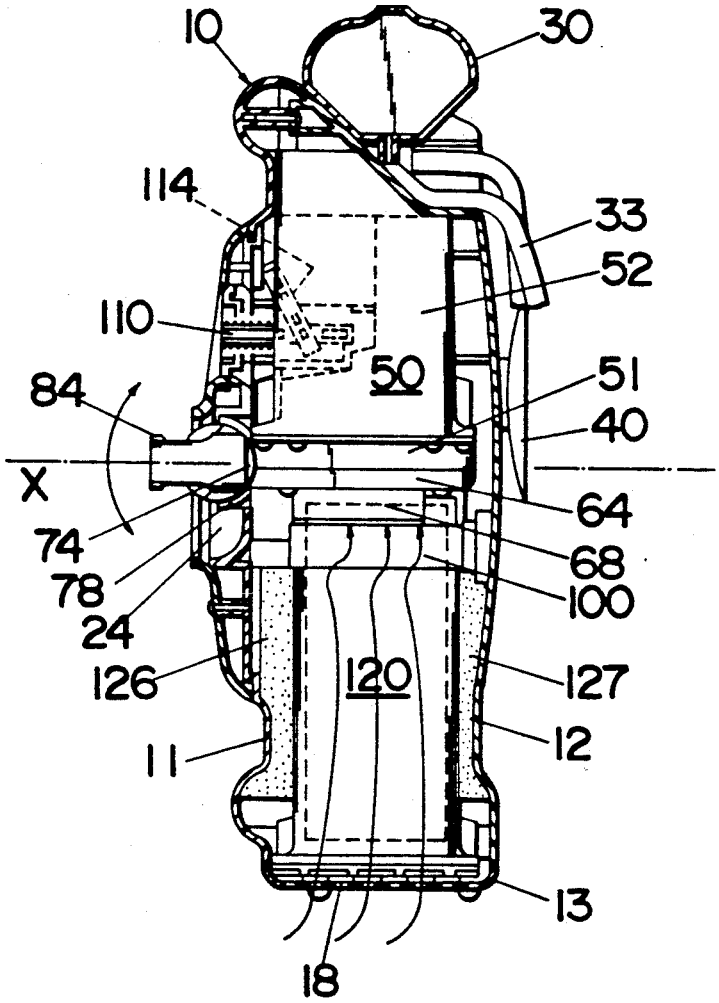
FIG. 5 is a vertical side sectional view of the above apparatus.
Figure 7:
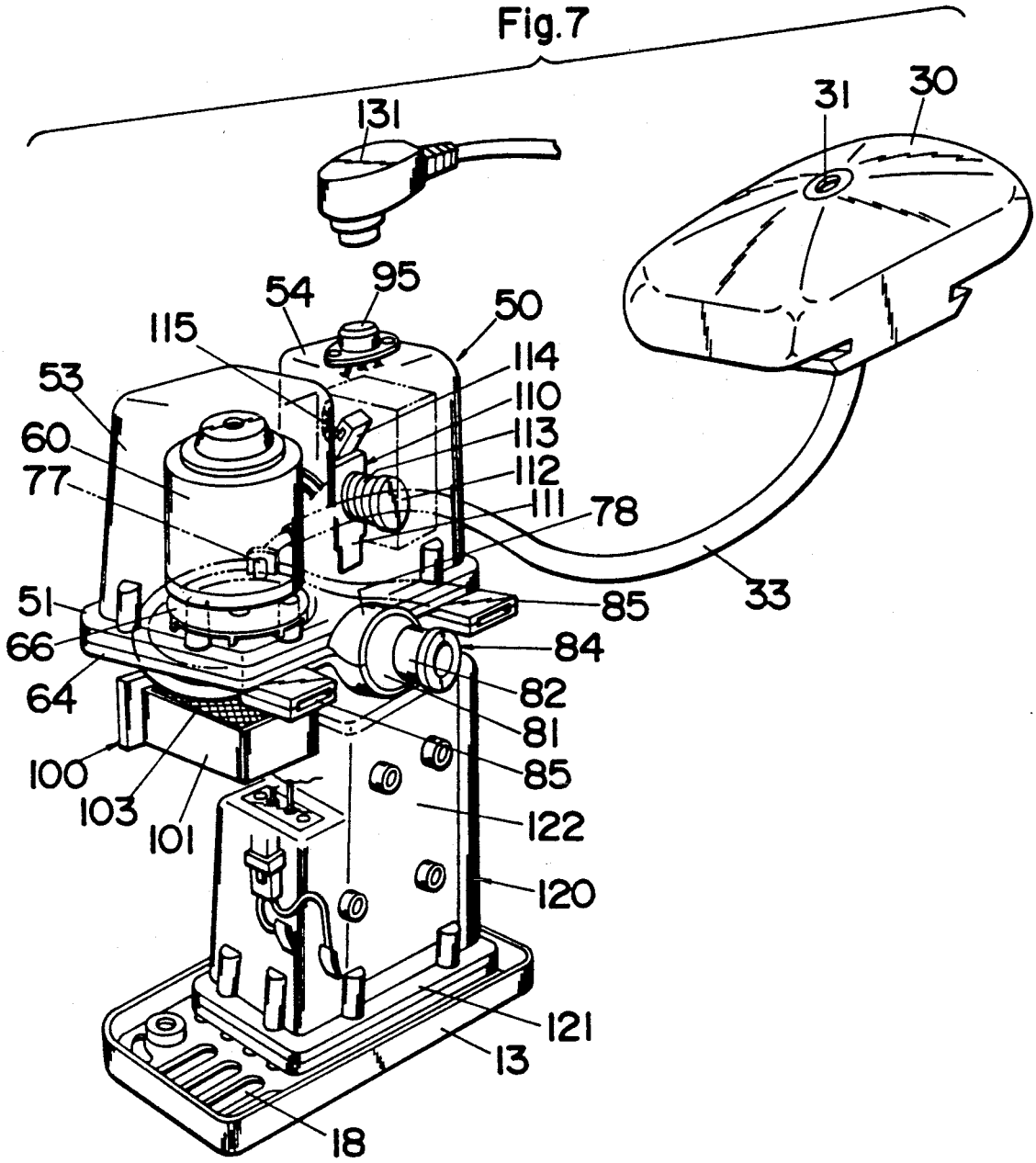
FIG. 7 is a perspective view of the above apparatus with a housing thereof removed.
Figure 8:
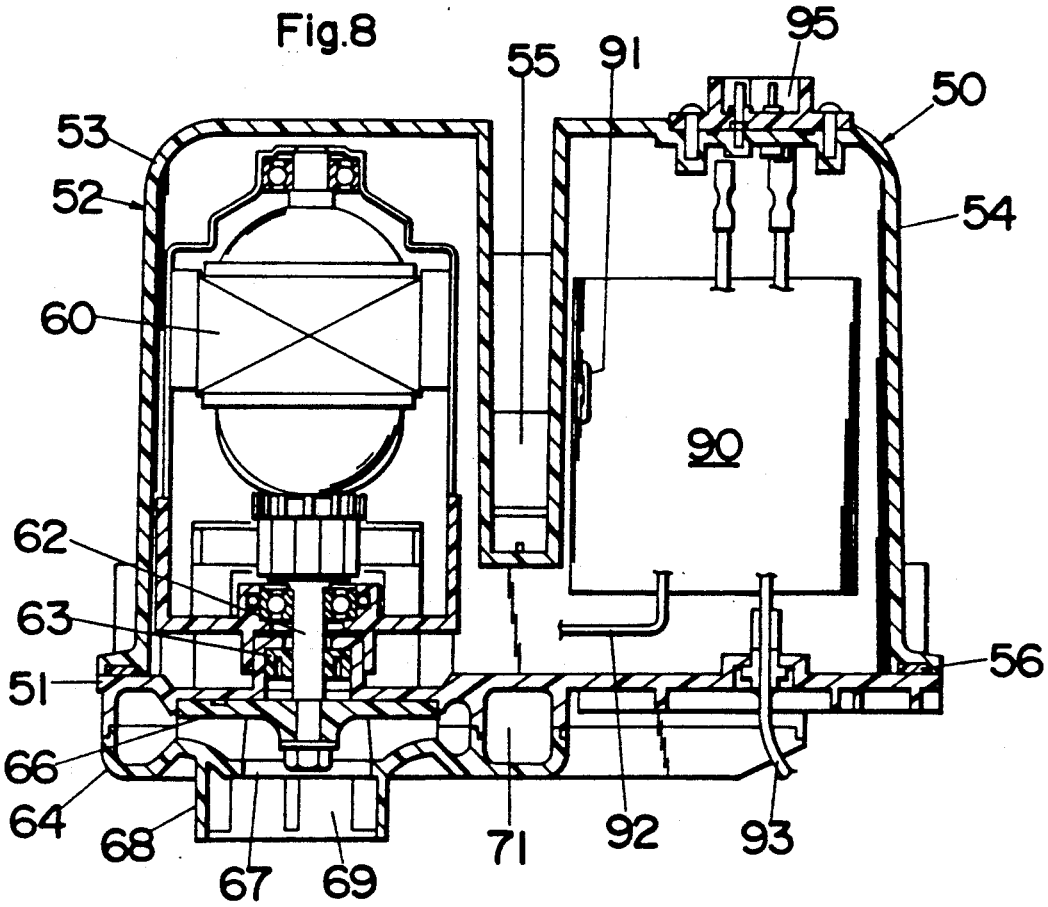
FIG. 8 is a vertical sectional view of a pump unit mounted within the above apparatus.

As shown in FIGS. 6 to 8, the pump unit 50 comprises a base 51 mounting thereon an electric motor 60 and an electric circuit block 90, and a cover 52 fitted on the base 51 to define therein two compartments respectively for receiving the motor 60 and a control circuit block 90. The cover 52 is shaped to have an outer configuration having two separated boxes 53 and 54 which define insides thereof the compartments and also define therebetween a vertically elongated recess 55 in which a switch assembly 110 is mounted. A seal ring 56 is interposed between the base 51 and the lower end of the cover 52 to effect water-tight sealing therebetween. The pump unit 50 also includes a member 64 which is fitted over the bottom of the base 51 to define therewith a pump casing of a volute pump. The volute pump includes an impeller 66 which is coupled to an output shaft 62 of the motor 60 and is driven thereby to rotate within the pump casing for drawing the water through an intake port 67 formed in the member 64 and producing a forced flow of water to be directed through a flow channel formed between the base 51 and the member 64 and discharged selectively through three nozzles 84 and 85 projecting on the front cover 11 of the housing 10. A seal 63 is fitted around the output shaft 52 outside of the base 51 for sealing therebetween. It is noted at this time that the bottom cover 13 of the housing 10 is provided with a plurality of water inlets 18 through which the bathtub water is drawn into the inside of the housing lo and is subsequently drawn into the intake port 67 of the pump. As shown in FIG. 8, a wall 68 depends integrally from the member 64 around the intake port 67 to define insides thereof a rectangular chamber 69 which is positioned immediately below the intake port 67 and has a bottom opening for contact with a filter 100 so that the water is drawn through the filter 100 and the chamber 69 into the intake port 67 of the volute pump. The chamber 69 has a larger cross-sectional area than the intake port 67 so as to receive the filter 100 of a correspondingly larger cross-sectional area in order to reduce flow resistance as well as to improve the filtering effect. The filter 100 comprises a top-and-bottom opened holder 101 and a filter element 102 received therein. The top opening of the holder 101 is provided with a screening net 103 which is held in contact with the lower ends of the depending wall 68. The filter element 102, which is made of foam plastics having intercommunicating cells, is detachably received in the holder 101 to be exposed through the bottom opening of the holder 101 into the inside of the housing 10 for filtering the incoming water through the interior of the housing 10. The filter holder 101 is inserted through a slot 21 formed in the rear cover 12 of the housing 10 and is retained in position within the housing 10 with an end plate 104 of the filer holder 101 closing the outer end of the slot 21. As shown in FIG. 4, the outer end of the slot 21 is formed with finger-trapping recesses 22 so that the user can easily grip the end plate 104 by the fingers extending into the recesses 22 in order to remove the filter from the housing 10 for cleaning the same from time to time.

Figure 9:
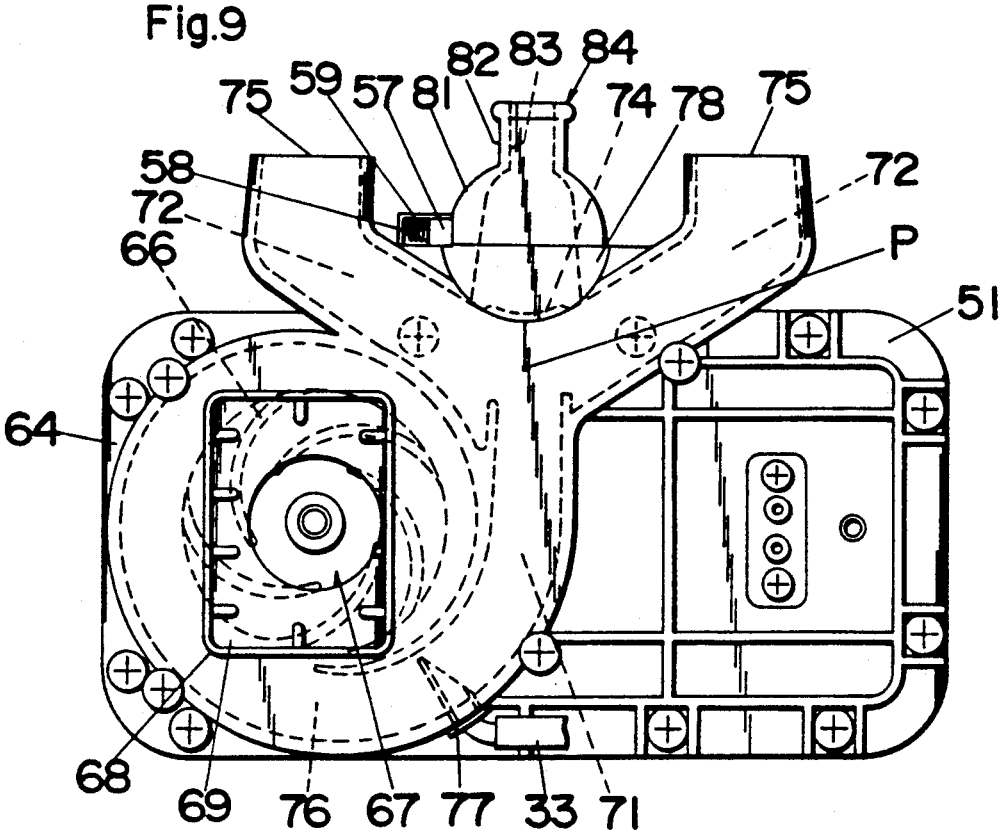
FIG. 9 is a bottom view of the pump unit.

As shown in FIG. 9, the flow channel of the volute pump casing extends in a horizontal plane to have a generally Y-shaped configuration with a main or common channel 71 and two separate branches 72. The main channel 71 comprises an arcuate path extending about a quarter of the circumference of the impeller 66 from an exhaust port 76 of the pump and a generally straight path extending to a point P of divergence from which the branches 72 extend in different directions. The branches 72 are formed at their ends respectively with side spouts 75 oriented in the same direction. Formed at the juncture of the branches 72 is a center spout 74 which is positioned downstream of the point P of divergence in straight alignment with the straight path of the flow channel and is associated with a directional center nozzle 84 capable of adjusting the discharging directions. Extending into the flow channel downstream of the exhaust port 76 is an air injector 77 which supplies the air from the float 30 through the pipe 33 to intermix the air into the water rushing from the exhaust port 76, to thereby generate the water-air jet to be discharged selectively through the center or side spouts 74 or 75. The water-jet thus obtained within the arcuate path of the flow channel will travel the generally straight path toward the center spout 74 such that, when the center spout 74 is in an open condition, the water-air mixture is directed straight past the point P of divergence and discharged through the center spout 74 without causing any substantial water-air jet to be directed through the branches 72. While, on the other hand, when the center spout 74 is in a closed condition as will be discussed later, the water-air mixture is divided into separate flows to be directed respectively through the branches 72 and discharged respectively through the side spouts 74. As shown in the figure, the air injector 77 extends into the arcuate path of the flow channel such that it can be spaced away by a relatively long distance sufficiently away from the point P of divergence so as to keep the air-intermixing effect thereof harmless from a turbulent flow which may occur at the point P of divergence when the center spout 74 is closed.

Figure 11A:
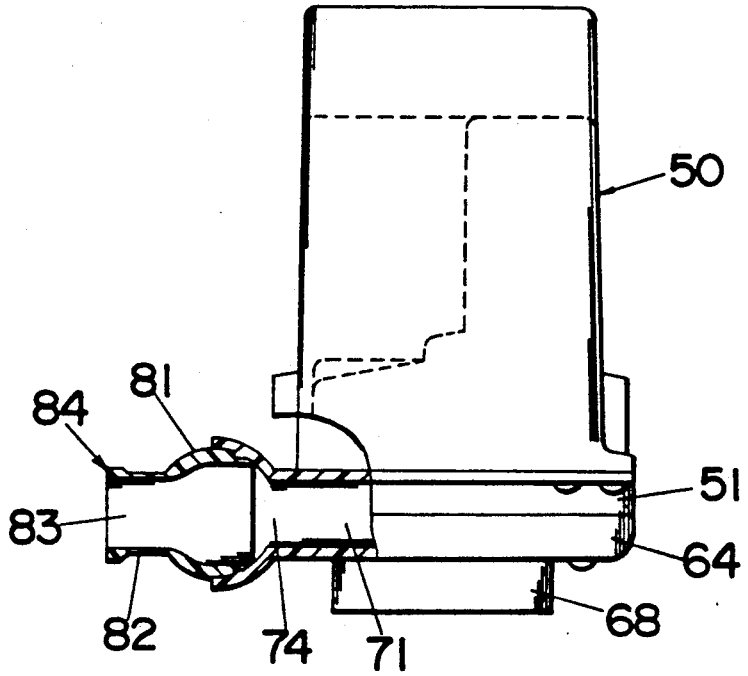
FIGS. 11A and 11B are explanatory views respectively illustrating the directional nozzle in its open and closed positions.
Figure 11B:
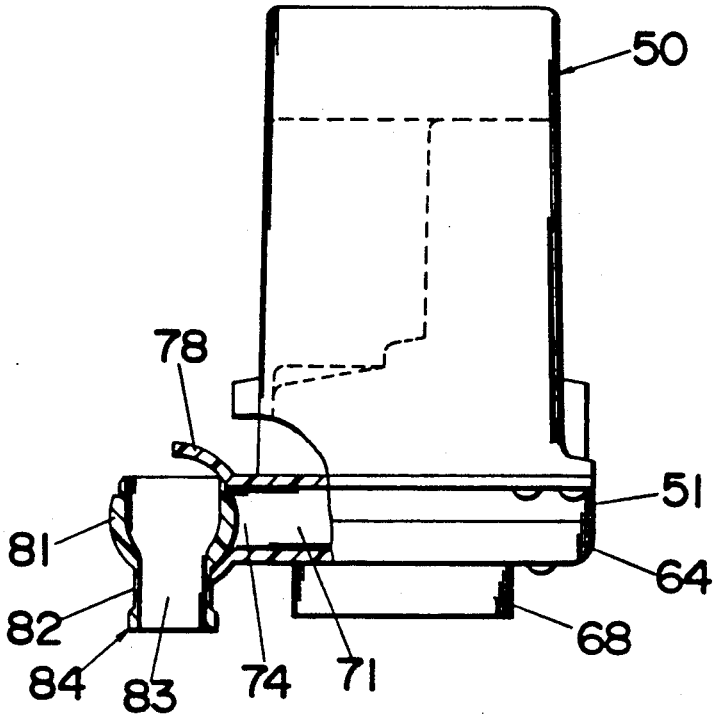
Figure 12A:
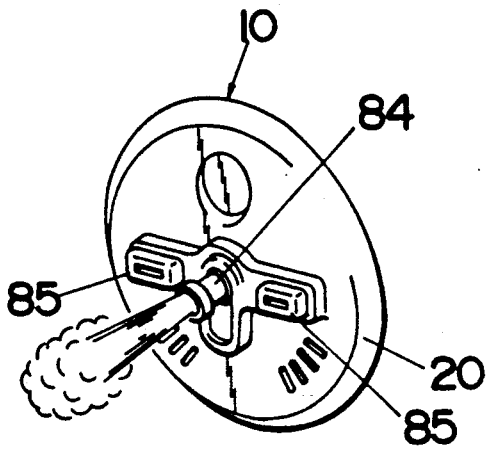
FIGS. 12A and 12B are explanatory views respectively illustrating the operations of the apparatus with the directional nozzle in its open and closed positions.
Figure 12B:
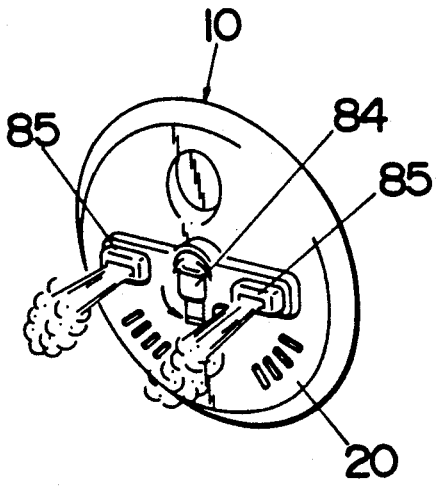

The center spout 74 is formed in the bottom of a semi-spherically shaped socket 78 formed between the base 51 and the member 64 for universal mounting of the center nozzle 84. The center nozzle 84 comprises a ball end 81 rotatably received in the socket 78 and a cylindrical stem 82 extending forwardly from the ball end 81. An axial bore 83 is formed to extend through the center nozzle 84 with its diameter smaller in the stem 82 than in the ball end 81. The stem 82 of the center nozzle 80 extends through a center opening 24 formed in the front cover 11 and the face plate 20 of the housing 10 to be accessible by the user for adjusting the direction thereof. Formed on the opposite sides of the center opening 24 are side nozzles 85 which project on the front cover 11 and form interior thereof cavities respectively for receiving the side spouts 75 for fluid intercommunication therebetween. The center opening 24 is vertically elongated and configured to allow the center nozzle 84 to move within a limited angular range of about 15° in all directions relative to a horizontal axis X of the houslng 10 extending through the center spout 74, but to allow the same to move downwards by about 90° into the center opening 24, which is referred to as a rest position of the center nozzle 84 in contrast to an operative position where the center nozzle 84 projects forwardly of the housing 10 as being suitably tilted within the limited range of angle relative to the horizontal axis X. While the center nozzle 84 is in the operative position, the axial bore 83 is kept in fluid communication with the center spout 74, as shown in FIG. 11A, in order to discharge the water-air mixture through the center nozzle 84, as shown in FIG. 12A. On the other hand, when the center nozzle 84 is deflected into the rest position, as shown in FIG. 11B, the center spout 74 is blocked by the ball section 81 of the deflected center nozzle 84 to stop discharging the water-air jet therethrough. When the center spout 74 is thus closed, the water-air jet directed through the flow channel is diverted into the branches 72 to be thereby discharged through the side nozzles 85, as shown in FIG. 12B. It should be noted at this time that, when the center nozzle 84 is in the operative position, the water-air mixture is allowed to be discharged substantially only through the center nozzle 84 and not through the side nozzles 85 due to the above particular configuration of the flow channel in relation to the center and side spouts 74. And when the center nozzle 84 is in the rest position of closing the center spout 74, the water-jet is allowed to be smoothly diverged into the branches 72 and discharged only through the side spouts 85. Therefore, the switching of the nozzles 84 and 85 can be made simply by manipulating the center nozzle 84 between the operative and rest positions, in the like manner as adjusting the flow direction of the water-air mixture from the center nozzle 84, and without requiring any other valve mechanism. It is noted at this time that the center nozzle 84 is designed to have the axial bore 83 which is narrower at the front end than at the rear for obtaining a relatively strong flow of the water-air mixture, while the side nozzles 85 (side spouts 75) are each shaped to have a flat wide opening for obtaining a relatively weak laterally spreading flow of the water-air mixture. The strong flow is preferred to apply an intense hydromassage effect to a restricted part of the body, while the weak flow is for applying a mild hydromassaging effect over an extended part of the body, for example, the opposite sides of the spine. Thus, the user can select the center and side nozzles 84 and 85 to enjoy different hydromassaging effects.

Figure 10:
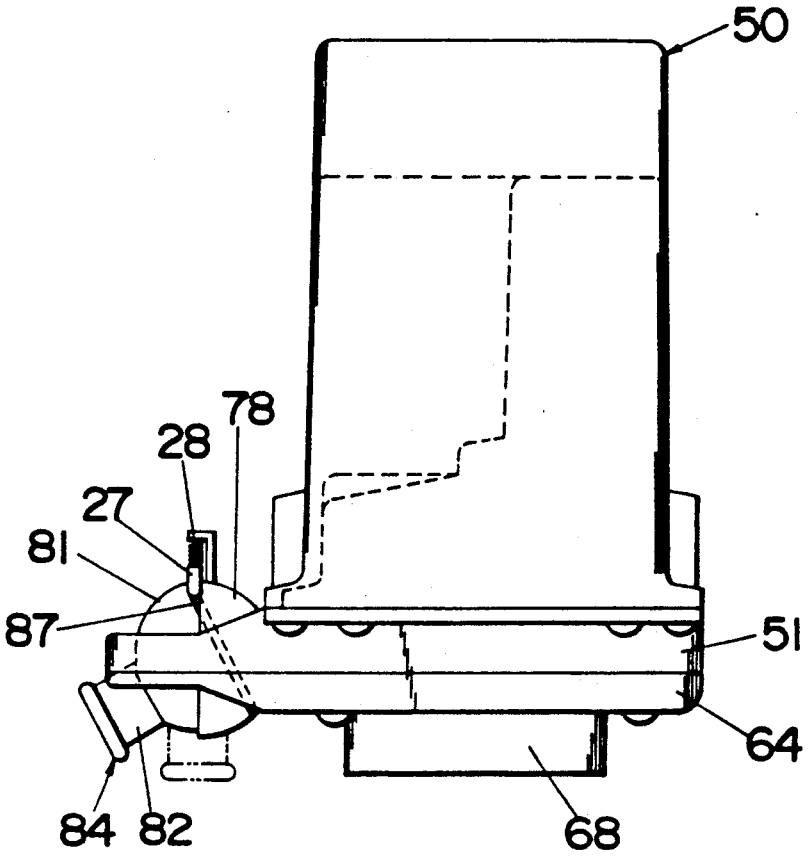
FIG. 10 is a side view of the pump unit with a directional nozzle.

The center nozzle 84 can be kept at a desired angular disposition by means of a friction piece 57 which, as shown in FIG. 9, is held within a slot 59 at the front of the base 51 together with a spring 58 urging the piece 57 against the curved surface of the ball end si of the nozzle 84. The inner end of the piece 57 is curved in conformity to the curvature of the ball end 81 to develop therebetween a frictional force by which the center nozzle 84 is retained at any desired angular disposition. Further, as shown in FIG. 10, the ball end 81 is formed at its rear portion with a circumferential groove 87 into which a click latch 27 engages as being biased by a spring 28. The click latch 27 will ride in and out of the groove 87 as the center nozzle 84 moves between the operative position and the rest position so as to give a clicking movement to the center nozzle 84. The click latch 27 and the spring 28 are held within a vertical slot (not shown) formed in the interior of the front cover 11 adjacent the center opening 24.

The switch assembly 110, which is held between the boxes 53 and 54 of the pump unit 50, comprises a frame 111 carrying a plunger 112 urged by a return spring 113 in the forward direction and a swing arm 114 connected at its end to the plunger 112 so that the other end will travel an elongated arcuate path as the plunger 112 moves back and forth in its axial direction. The other end of the arm 114 carries a permanent magnet 115 which actuates a reed relay 91 concealed in the box 53 so as to energize and deenergize the motor 60 in response to the axial movement of the plunger 112. The front end of the plunger 112 is positioned immediately behind an elastic membrane 26 fitted in the front cover 11 so that the user can operate the plunger 112 through the membrane 26.

The reed relay 91 is included in the control circuit block 90 which is also concealed within the box 54 and electrically connected to the motor 60 by leads 92 routed interior of the pump unit 50 and also connected to a rechargeable battery 125 of the battery unit 120 by leads 93 extending outwardly from the pump unit 50 into the battery unit 120. The control circuit 90 is provided for controls of driving the motor 60 as well as of charging the rechargeable battery 125. In controlling the motor 60, the control circuit 90 is latched in to energize the motor 60 to start discharging the water-air jet when the plunger 112 is pushed in to move the permanent magnet 115 rearwardly and actuate the reed switch 91, after which the plunger 112 returns forwardly by the return spring 113. When the plunger 112 is again pushed in, the control circuit 90 responds to deenergize the motor 60 and stop discharging the water-air jet. Projecting on the upper end of the box 54 of the pump unit 50 is a charging terminal 95 to which a plug 131 of a charger unit 130 is detachably coupled for charging the battery 125. The charging terminal 95 is connected through the control circuit 90 to the battery 125 such that the control circuit 90 controls the charging of the battery 125 in an optimum manner while preventing the over-charging thereof. The control circuit 90 also operates to stop supplying the motor current when the voltage level of the battery 125 is dropped below a reference level. The charging terminal 95 is properly sealed to provide a watertight sealing between the pump cover 52 and the terminal 95 and is accessible through an opening (not shown) with a shutter formed in the upper wall of the rear cover 12 of the housing 10. Further, the control circuit 90 includes a load-responsive switch which constantly monitors the motor current in order to cease driving the motor 60 when the motor current is either below a predetermined low level reference indicative of that the motor 60 is being driven under substantially no load condition or above a predetermined high level reference indicative of that the motor 60 is being driven under over-load condition for protection of the motor 60.

The battery unit 120 includes a mount base 121 for the battery 125 and a casing 122 fitted on the base 121 with a seal ring 123 interposed therebetween to provide a sealed casing surrounding the battery 125. The base 121 is provided with a valve (not shown) which is capable of exhausting excess hydrogen gas developed at the charging of the battery 125 but of preventing the entry of the water into the battery casing. The battery unit 120 may include a catalyst by which the hydrogen gas is converted into water. It is noted in this connection that since the battery 125 and the motor 60 are sealed separately in the pump casing and the battery casing the motor 60 can be free from being exposed to the hydrogen gas which may be developed in the battery casing and therefore can be protected from an accidental explosion.

The battery unit 120 which is of itself heavy weight nature is disposed within the bottom of the housing 10 below the pump unit 50 so as to provide a stabilized balancing of the apparatus for facilitating the use in the water. Further, as best shown in FIG. 7, the battery unit 120 is laterally offset from the center of the housing 10 in the direction opposite of the motor 60 which is also of relatively heavy nature in order to effect a lateral balancing of the apparatus, whereby keeping the apparatus in an exact position in the water of horizontally align the center and side nozzles 84 and 85 when the apparatus is held in the water with or without the float 30 attached on top of the housing 10. Disposed on the front and back of the battery unit 120 are cushioning members 126 and 127 which are made of foamed plastic having non-intercommunicating cells and also give additional buoyancy to the apparatus. Like cushioning member may be provided in other portion of the housing 10.

As shown in FIG. 1, the battery charger 130 having the plug 131 for connection with the charging terminal 115 as well as a power cord 132 is detachably held on the side of a tray 140 which supports the apparatus at the time of charging of the battery 125. The tray 140 has in its bottom a sink 141 for receiving the water dripping out of the apparatus back through the water inlet 18 in the bottom of the housing 10. After the water is recovered from the apparatus, the tray 140 is detached from the charger 130 for disposal of the water. The charger 130 is provided with an indicator 133 which is turned on while charging the battery 125.

What is claimed is:

1. A hydromassaging apparatus adapted for use in a bathtub comprising:

a housing incorporating pump means for drawing water from the bathtub and intermixing air into the water to produce a water-air mixture to be discharged into said bathtub, said housing including a plurality of spouts for discharging said water-air mixture;

at least one of said spouts having a directional nozzle which is movable relative to said spout for adjusting the direction of the water-air mixture discharged into the bathtub, said directional nozzle projecting from the housing to be accessible by the user;

said directional nozzle being coupled to said spout in such a manner that it is kept in fluid communication therewith to permit the water-air mixture to be discharged through the directional nozzle so long as the directional nozzle is angularly displaced within a limited range of angles relative to an axis of the corresponding spout, and that said directional nozzle comes out of fluid communication with said spout when said directional nozzle is angularly displaced beyond the limited range of angles to thereby close said spout and permit said water-air mixture to be discharged into the bathtub through the other spout or spouts;

said housing including a flow channel leading from said pump means to said individual plural spouts, said flow channel having a common point downstream of said pump means from which point a plurality of flow paths diverge in different direction to said individual spouts, one of said flow paths leading to said spout having said directional nozzle extending in substantially the same direction as the flow direction of the water-air mixture reaching said common point from said pump means such that the water-air mixture from said pump means is directed to said spout having said nozzle and no substantial flow of said water-air mixture is directed to said other spout or spouts when said directional nozzle is in an enable position of discharging the water-air jet therethrough.

2. A hydromassaging apparatus as set forth in claim 1, wherein said spouts are aligned horizontally with said directional nozzle provided in the center one of said spouts.

3. A hydromassaging apparatus as set forth in claim 2, wherein said directional nozzle has a cylindrical aperture which is narrower toward its discharge end for producing a relatively strong water-air jet and said spouts on the opposite sides of the center spout has a flat wide aperture at the respective discharge ends for producing a relatively weak water-air jet.

* * * * *